US005460554A

United States Patent [19]

Funami et al.

[11] Patent Number: 5,460,554

[45] Date of Patent: Oct. 24, 1995

[54] STEERING SYSTEM FOR BOAT PROPELLING APPARATUS

[75] Inventors: Yasuo Funami; Manabu Nishi; Yoshimi Watanabe; Shunya Senda, all of Gyoda, Japan

[73] Assignee: Showa Corporation, Saitama, Japan

[21] Appl. No.: 255,161

[22] Filed: Jun. 7, 1994

[30] Foreign Application Priority Data

| | | | |
|---|---|---|---|
| Jun. 10, 1993 | [JP] | Japan | 5-163839 |
| Jun. 10, 1993 | [JP] | Japan | 5-163840 |
| Jun. 10, 1993 | [JP] | Japan | 5-163841 |

[51] Int. Cl.[6] ..... B63H 20/12

[52] U.S. Cl. ..... 440/61; 114/150

[58] Field of Search ..... 114/150; 440/61, 440/62

[56] References Cited

U.S. PATENT DOCUMENTS

| | | | |
|---|---|---|---|
| 4,595,370 | 6/1986 | Small | 440/53 |
| 4,976,639 | 12/1990 | Rawlings et al. | 440/59 |
| 5,350,326 | 9/1994 | Funami | 114/150 X |

FOREIGN PATENT DOCUMENTS

| | | | |
|---|---|---|---|
| 2-147497 | 6/1990 | Japan . | |
| 5039050 | 2/1993 | Japan | 440/61 |

*Primary Examiner*—Sherman Basinger
*Attorney, Agent, or Firm*—Frishauf, Holtz, Goodman, Langer & Chick

[57] ABSTRACT

A steering system for a boat propelling apparatus is disclosed, which includes an operation unit, a steering piston-and-cylinder assembly and an operating fluid switching unit. The operation unit causes a steering arm of a propelling unit to be operated with operation of a steering wheel installed in the boat. The steering piston-and-cylinder assembly is connected to an operating fluid supply pump and a drain tank and capable of being supplied with operating fluid. Its piston rod is coupled to the steering arm. The operating fluid switching unit is disposed between the steering piston-and-cylinder assembly on one hand and the operating fluid supply pump and the drain tank on the other hand, and it switches the flow of operating fluid with the operation of the operation unit. It includes a switching section having a poppet valve coupled to the operation unit. The operating fluid switching unit includes a switching section and a normally closed drain control section. The switching section switches the flow of operating fluid directed form the operating fluid supply pump to the steering piston-and-cylinder assembly. The drain control section controls the flow of operating fluid directed from the operating fluid supply pump to the drain tank, and after the lapse of a predetermined period of time from the instant of start of the operating fluid supply pump it is closed, whereby operating fluid is led to the switching section only. The operating fluid supply pump is operative at all times, and it leads operating fluid through the drain control section to the drain tank in the inoperative state of the operation unit while leading operating fluid through the switching section to the steering piston-and-cylinder assembly in the operative state of the operation unit.

4 Claims, 10 Drawing Sheets

STEERING SYSTEM FOR BOAT PROPELLING APPARATUS

BACKGROUND OF THE INVENTION

1. Field of the Invention

This invention relates to a steering system for a boat propelling apparatus such as an outboard motor or an inboard/outboard motor.

2. Description of the Background Art

Among the prior art steering systems for boat propelling apparatus are those disclosed in Tokkai Hei 2-147497 (U.S. Pat. No. 4,976,639) and U.S. Pat. No. 4,595,370. In such a steering system, a propelling unit having a propeller is steerably supported on the boat, and a steering piston-and-cylinder assembly is secured to the boat. The steering piston-and-cylinder assembly has its piston rod coupled to a steering arm which can steer the propelling unit. An operation cable which is coupled to a steering wheel provided in the boat, is secured to the steering arm. The operation cable operates a spool valve in an oil hydraulic operating fluid switching unit for switching the flow of operating fluid supplied to the steering piston-and-cylinder assembly. The operating force of the steering wheel is transmitted to the operation cable, whereby the spool valve of the operating fluid switching unit is moved to switch the flow of operating fluid to the steering piston-and-cylinder assembly. Thus, the propelling unit is steered by the operating fluid pressure of the steering piston-and-cylinder assembly.

In the above steering system for the boat propelling apparatus, however, the operating fluid switching unit has a switching section comprising a spool valve. This means that a play for the sliding of the spool is formed between the spool and a sleeve. Therefore, when an external force is applied to the propelling unit at the time of generation of a steering assist force by the steering piston-and-cylinder assembly, the operating fluid may be caused to flow through the play, thus making the steering unstable.

In the above steering system for the boat propelling apparatus, an oil hydraulic operating fluid supply pump which supplies oil hydraulic operating fluid through the oil hydraulic operating fluid switching unit to the steering piston-and-cylinder assembly, is stopped in the absence of any operating force being applied to the steering wheel, and is started upon application of the operating force. Therefore, at the time of the start of the operating fluid supply pump, operating fluid is caused to flow suddenly into the steering piston-and-cylinder assembly, thus preventing or interfering with a smooth increase of the steering assist force generated in the steering piston-and-cylinder assembly.

Further, as for the start and stop of the above operating fluid supply pump, stringently the oil hydraulic operating fluid supply pump is not started simultaneously with the application of the operating force to the steering wheel, but some delay time is involved due to the mechanical structure. This may result in reduction of the response of the assist force generated in the steering piston-and-cylinder assembly.

SUMMARY OF THE INVENTION

A first object of the invention, which has been intended in view of the above circumstances, is to provide a steering system for a boat propelling apparatus, which can prevent leak of operating fluid in the operating fluid switching unit to prevent adverse effects of an external force applied to the boat propelling apparatus, thus ensuring the stability of steering.

A second object of the invention is to provide a steering system for a boat propelling apparatus, which permits a smooth increase of the steering assist force generated at the time of the start of the oil hydraulic operating fluid supply pump.

A third object of the invention is to provide a steering system for a boat propelling apparatus, which permits satisfactory supply of operating fluid from the operating fluid supply pump and fast and smooth generation of the steering assist force in response to application of an operating force to the steering wheel.

To attain the first object of the invention, there is provided a steering system for a boat propelling apparatus, which comprises a propelling unit mounted on a boat via a bracket and having a steering arm, an operating unit operable by operating a steering wheel installed in the boat, the operating unit being coupled to the steering arm, a steering piston-and-cylinder assembly mounted on the bracket and having a piston rod connected to the steering arm, the steering piston-and-cylinder assembly being connected to and capable of being supplied with operating fluid from an operating fluid supply pump and a drain tank, and an operating fluid switching unit disposed between the steering piston-and-cylinder assembly on one hand and the operating fluid supply pump and the drain tank on the other hand and coupled to the operation unit, for switching the flow of operating fluid with the operation of the operation unit, the operating fluid switching unit including a switching section coupled to the operation unit, the switching section including a poppet valve.

In a preferred embodiment of the invention, two poppet valves are provided, one of the two popper valves serving to switch the flow of operating fluid directed from the operating fluid supply pump to the steering piston-and-cylinder unit, the other poppet valve serving to control the flow of operating fluid directed from the steering piston-and-cylinder assembly to the drain tank, the two poppet valves being operated selectively.

Since according to the invention the switching section of the oil hydraulic operating fluid switching unit comprises poppet valves, the leak of operating fluid in the operating fluid switching unit can be significantly reduced compared to the use of a switching section comprising a spool valve. Thus, external forces applied to the boat propelling apparatus during the steering have no adverse effect, and it is possible to ensure stable steering.

To attain the second object of the invention, there is provided a steering system for a boat propelling apparatus, which comprises a propelling unit mounted on a boat via a bracket and having a steering arm, an operating unit operable by operating a steering wheel installed in the boat, the operating unit being coupled to the steering arm, a steering piston-and-cylinder assembly mounted on the bracket and having a piston rod connected to the steering arm, the steering piston-and-cylinder assembly being connected to and capable of being supplied with operating fluid from an operating fluid supply pump and a drain tank, and an operating fluid switching unit disposed between the steering piston-and-cylinder assembly on one hand and the operating fluid supply pump and the drain tank on the other hand and coupled to the operation unit, for switching the flow of operating fluid with the operation of the operation unit, the operating fluid switching unit including a switching section for switching the flow of the operating fluid directed from the operating fluid supply pump to the steering piston-and-cylinder assembly, and a normally open drain control section for controlling the flow of the operating fluid directed from the operating fluid supply pump to the drain tank, the drain control section being closed after the lapse of a predetermined period of time from the instant of the start of the operating fluid supply pump, whereby the operating fluid is led to the switching section only.

Since according to the invention as noted above the operating fluid from the operating fluid supply pump flows to both the drain control section and the switching section for a predetermined period of time after the start of the operating fluid supply pump and, with subsequent closure of the drain control section, flows to the sole switching section, there is no possibility for the operating fluid to flow suddenly through the switching section to the steering piston-and-cylinder assembly at the time of the start of the operating fluid supply pump. It is thus possible to obtain a smooth increase of the steering assist force generated at the time of the start of the operating fluid supply pump.

To attain the third object of the invention, there is provided a steering system for a boat propelling apparatus, which comprises a propelling unit mounted on a boat via a bracket and having a steering arm, an operation unit operable by operating a steering wheel installed in the boat, the operating unit being coupled to the steering arm, a steering piston-and-cylinder assembly mounted on the bracket and having a piston rod connected to the steering arm, the steering piston-and-cylinder assembly being connected to and capable of being supplied with operating fluid from an operating fluid supply pump and a drain tank, and an operating fluid switching unit disposed between the steering piston-and-cylinder assembly on one hand and the operating fluid supply pump and the drain tank on the other hand and coupled to the operation unit, for switching the flow of operating fluid with the operation of the operation unit, the operating fluid supply pump being operative at all times, operating fluid being led through the drain control section to the drain tank in the inoperative state of the operation unit and led through the switching section to the steering piston-and-cylinder assembly in the operative state of the operation unit.

Since according to the invention as noted above the operating fluid supply pump is operative at all times, there is no possibility of delay of the start of the operating fluid supply pump with respect to the operation of the operation unit, thus permitting the operating fluid to be led quickly and smoothly through the switching section to the steering piston-and-cylinder assembly in response to application of an operating force to the steering wheel. The steering assist force thus can be generated quickly and smoothly from the steering piston-and-cylinder assembly.

BRIEF DESCRIPTION OF THE DRAWINGS

The present invention will be more fully understood from the detailed description given below and from the accompanying drawings which should not be taken to be a limitation on the invention, but for explanation and understanding only.

The drawings.

DESCRIPTION OF THE PREFERRED EMBODIMENTS

Now, a first embodiment of the invention will be described with reference to FIGS. 1 to 10.

Figure 1:
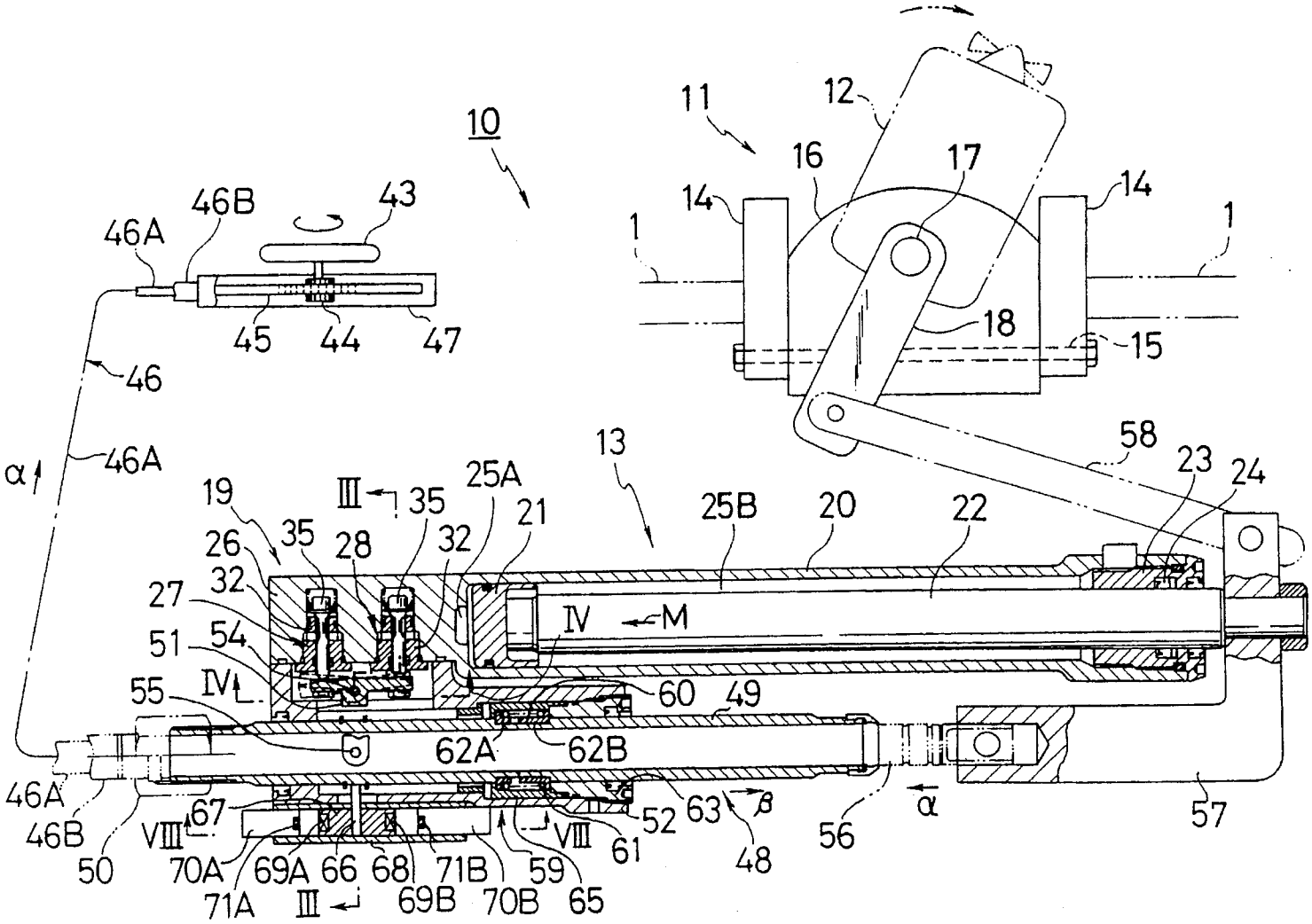
FIG. 1 is a schematic view, partly in section, showing a first embodiment of the steering system for a boat propelling apparatus according to the invention applied to an outboard motor.

Referring to FIG. 1, there is shown a steering system 10, which steers a propelling unit 12 of an outboard motor 11 used as a boat propelling apparatus with an oil hydraulic pressure of operating fluid from a steering piston-and-cylinder assembly 13. The outboard motor 11 has a clamp bracket 14 secured to the boat 1. A swivel bracket 16 is titably supported via tillable shaft 15 on the clamp bracket 14. A steering shaft 17 is rotatably supported on the swivel bracket 16. The propelling unit 12 is secured to the steering shaft 17. A steering arm 18 is provided such that it is integral with the steering shaft 17 and extends away from propelling unit 12. The propelling unit 12 is steered by rocking the steering arm 18.

The steering piston-and-cylinder assembly 13 is mounted on the swivel bracket 16. A fluid switching unit 19 is disposed on one side of the steering piston-and-cylinder assembly 13. In the steering piston-and-cylinder assembly 13, a piston 21 is disposed for reciprocation in a cylinder 20. A piston rod 22 is integral with the piston 21. A cylinder cap 23 is screwed into an end of the cylinder 20 in which the piston rod 22 is received. The piston rod 22 penetrates the cylinder cap 23 such that it can project therefrom. A seal ring 24 is fitted in the inner periphery of the cylinder cap 23. The interior of the cylinder 20, which is sealed by the seal ring 24, is partitioned by the piston 21 into a left and a fight chamber 25A and 25B.

Figure 2:
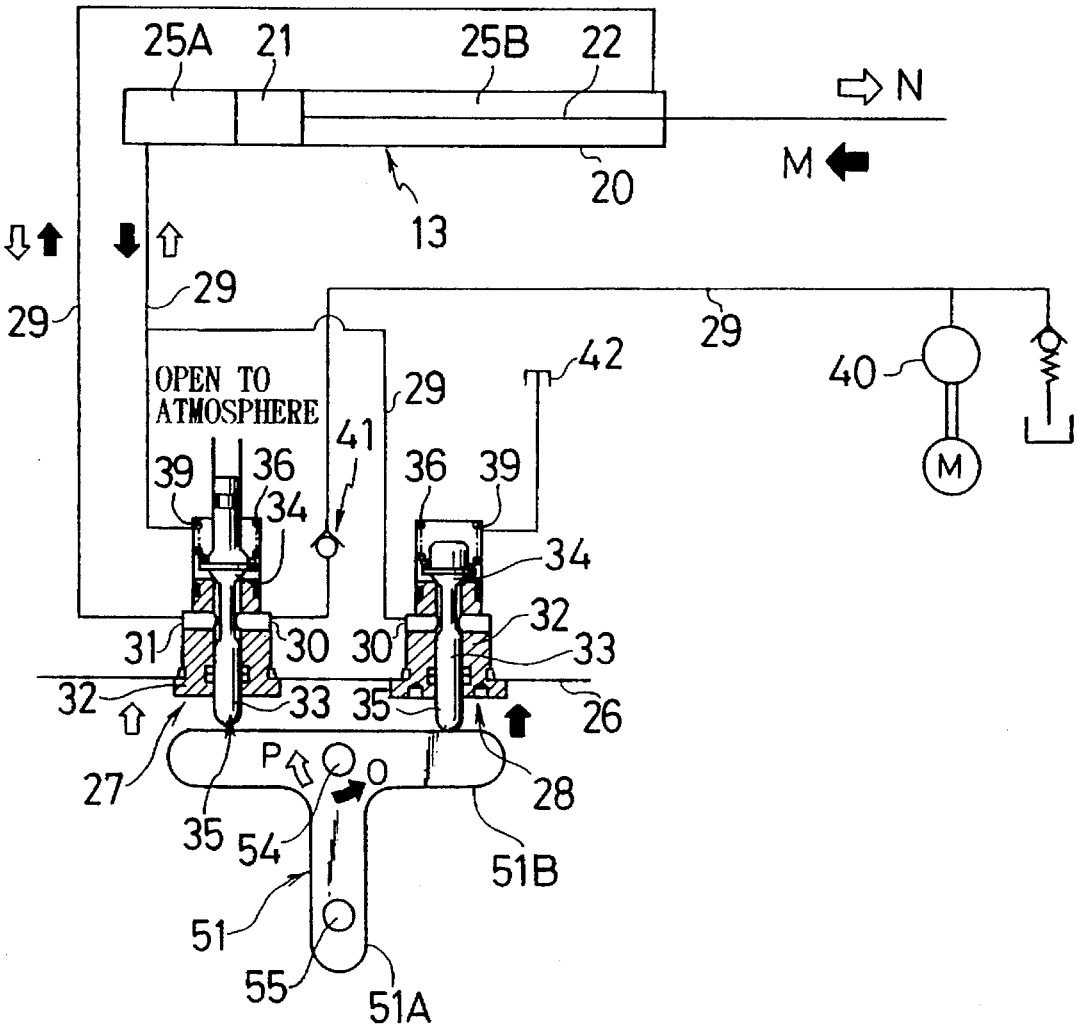
FIG. 2 is an oil hydraulic circuit diagram showing an oil hydraulic circuit of the steering system shown in FIG. 1.

The oil hydraulic operating fluid switching unit 19 includes a housing 26, a pair of switching poppet valves, i.e., a first and a second switching poppet valve 27 and 28, and an operating fluid path 29 (FIG. 2). The housing 26 is secured to an end of the cylinder 20 from which the piston rod 22 does not project.

Figure 5:
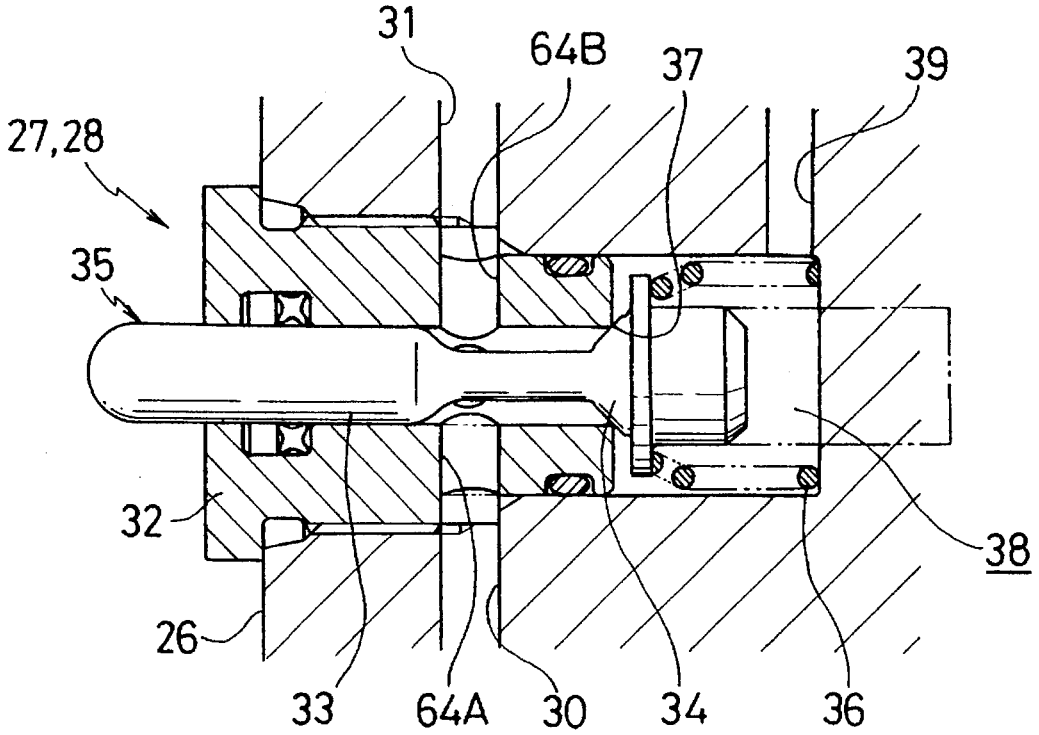
FIG. 5 is an enlarged-scale sectional view showing a poppet valve shown in FIG. 1.

As shown in FIG. 5, the first and second switching poppet valves 27 and 28 each comprise a valve case 32 with flow paths 64A and 64B formed therein and a poppet 35 slidably disposed in the valve case 32 and having valve sections 33 and 34. Port 31 and flow path 64B are formed in the first switching poppet valve 27 only. The flow paths 64A and 64B are communicated with respective ports 30 and 31 of the housing 26. The ports 30 and 31 are normally in a communicated state with each other.

The valve section 34 can be brought into contact with a valve seat 37 by a spring force of a valve spring 36. The housing 26 has a valve chamber 38, in which the valve spring 36 is disposed, and which is formed with a port 39. With the valve section 34 brought into contact with the valve seat 37 by the biasing force of the valve spring 36, the port 39 is blocked from communication with the ports 30 and 31. With the valve section 34 brought away from the valve seat 37, the port 39 is communicated with the ports 30 and 31.

The operating fluid path 29, as shown in FIG. 2, connects an operating fluid supply pump 40 via a check valve 41 to the port 30 of the first switching poppet valve 27. The port 31 of the first switching poppet valve 27 is connected via the operating fluid path 29 to the right chamber 25B of the steering piston-and-cylinder assembly 13. The port 39 of the first switching poppet valve 27 is connected via the operating fluid path 29 to the left chamber 25A of the steering piston-and-cylinder assembly 13. Through the first switching poppet valve 27, oil hydraulic operating fluid is supplied from the operating fluid supply pump 40 to the steering piston-and-cylinder assembly 13.

The port 30 of the second switching poppet valve 28 is connected via the operating fluid path 29 to the left chamber 25A of the steering piston-and-cylinder assembly 30. The port 39 of the second switching poppet valve 28 is connected to a drain tank 42. Thus, the second switching poppet valve 28 controls the flow of operating fluid directed from the steering piston-and-cylinder assembly 13 to the drain tank 42.

The poppets 35 of the first and second switching poppet valves 27 and 28 are selectively pushed by a switching lever 51 to be described later in detail. When the poppet 35 of the second switching poppet valve 28 is pushed as switching lever 51 moves in the direction shown by black arrow O, the ports 30 and 39 of the second switching poppet valve 28 are communicated with each other. Thus, operating fluid from the operating fluid supply pump 40 is supplied through the ports 30 and 31 of the first switching poppet valve 27 to the right chamber 25B of the steering piston-and-cylinder assembly 13. At this time, operating fluid in the left chamber 25A of the steering piston-and-cylinder assembly 13 is led to the port 30 of the second switching poppet valve 28 and thence through the port 39 thereof to the drain tank 42. Thus, the piston rod 22 of the steering piston-and-cylinder assembly 13 is contracted as piston 21 moves in the direction of black arrow M.

When the poppet 35 of the first switching poppet valve 27 is pushed due to switching lever 51 being moved in the direction of white arrow P, the ports 30 and 31 of the first switching poppet valve 27 are communicated with the port 39 thereof. At this time, the operating fluid from the operating fluid supply pump 40 is led through the port 30 of the first switching poppet valve 27 to the ports 39 and 31 and thence to the left and right chambers 25A and 25B in the steering piston-and-cylinder assembly 13. Since at this time the area of pressure reception in the piston 21 of the steering piston-and-cylinder assembly is greater on the side of the left chamber 25A than the side of the right chamber 25B, the piston rod 22 is extended in the direction of white arrow N, thus forcing the operating fluid in the right chamber 25B through the port 31 of the first switching poppet valve 27 to the port 39 and thence to the left chamber 25A of the steering piston-and-cylinder assembly 13.

When the poppet 35 of neither the first nor the second switching poppet valve 27 or 28 is pushed and also the operating fluid supply pump 40 is stopped (as will be described later), the check valve 41 blocks the flow of operating fluid irrespective of application of an external force to the piston rod 22 of the steering piston-and-cylinder assembly 13, thus preventing the operation of the piston rod 22.

Referring back to FIG. 1, a steering wheel 43 is installed in a driver's seat in the boat 1. The steering wheel 43 has a pinion 44. A rack bar 45 is in mesh with the pinion 44. An inner cable 46A of an operating cable 46 is connected to the rack bar 45. The operating cable 46 comprises the inner cable 46A and an outer cable 46B covering the inner cable 46A. A rack bar housing 47 is secured to one end of the outer cable 46B, the other end of which is connected via a blind nut 50 to a cable guide 49 of an operation unit 48.

Figure 3:
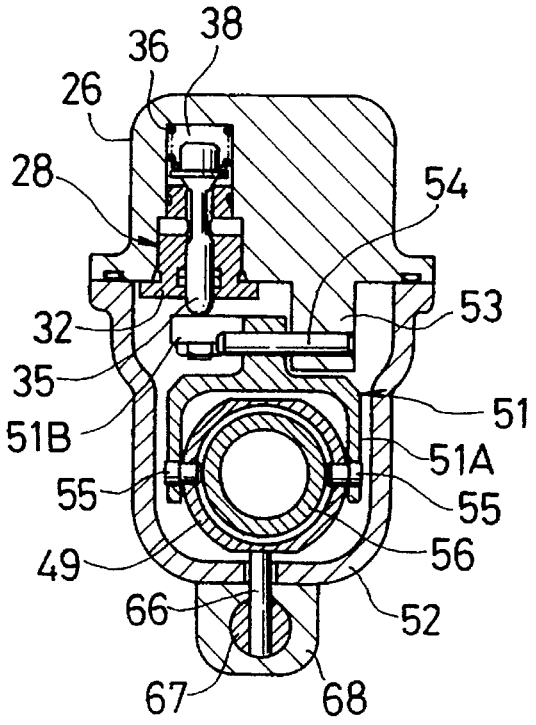
FIG. 3 is a sectional view taken along line III—III in FIG. 1.
Figure 4:
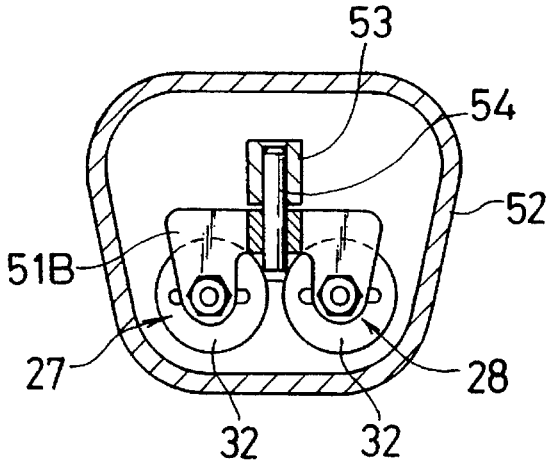
FIG. 4 is a sectional view taken along line IV—IV in FIG. 1.

The operation unit 48 includes a cable guide housing 52 as well as the cable guide 49 and the switching lever 51 noted above. The cable guide housing 52, as shown in FIGS. 1 and 3, is secured by bolts or the like to switching unit housing 26 such as to cover the first and second switching poppet valves 27 and 28. The cable guide 49 is slidably disposed in the cable guide housing 52. The switching lever 51 is rotatably secured by pin 54 to lever support 53 of the switching unit housing 26 for rotation around pin 54 in the directions of arrows O and P noted above. The switching lever 51, as shown in FIG. 3, has a bifurcated lower portion 51A, which is secured by set pins 55 to the cable guide 49. An upper portion 51B of the switching lever 51 as shown in FIG. 3 and in FIG. 4, is movable up to a position above the lower end of both the first and second switching poppet valves 27 and 28 so that it can push the poppets 35 thereof upward.

A core 56 which is connected to the inner cable 46A of the operating cable 46 is inserted through the cable guide 49. The core 56 and the piston 22 of the steering piston-and-cylinder assembly 13 are both connected to a clevis 57. The clevis 57 is coupled via a rod link 58 to the steering arm 18.

When the operating force of the steering wheel 43 is applied to the inner cable 46A of the operating cable 46 in the direction of arrow $\alpha$, for instance, it acts via the core 56 and the clevis 57 to move the steering arm 18. At this time, a steering resistance force (which acts in the direction of arrow $\beta$, opposite to the direction of the operating force) acts on the inner cable 46A and the outer cable 46B by friction between these cables 46A and 46B. Thus, the cable guide 49 is moved in the direction of arrow $\beta$ via the set pins 55. As a result, the switching lever 51 is rotated about the pin 54 in the direction of arrow O (FIG. 2), thus pushing the poppet 35 of the second switching poppet valve 28. Thus, the operating fluid supplied from the operating fluid supply pump 40 flows into the right chamber 25B, in the steering piston-and-cylinder assembly 13 to cause movement of the piston 21 and piston rod 22 in the direction of arrow M. The piston rod 22 applies a steering assist force to the steering arm 18 in the same direction as the force applied by steering wheel 43 via inner cable 46A and the core 56 to the steering arm 18.

The operation unit 48, as shown in FIG. 1, includes a neutral position restoration unit 59 for restoring the neutral position of the cable guide 49 when it has been moved slightly. The neutral position restoration unit 59 includes an outer groove 60 formed in the cable guide 49, a pair of movable members 62A and 62B fitted in the outer groove 60 such as being separated from each other by a compression spring 61, a housing cap 63 screwed in the cable guide housing 52 and locking the movable member 62B, and a retainer 65 screwed in the housing cap 63 and locking the other movable member 62A.

With slight sliding of the cable guide 49 the compression spring 61 is compressed, and the biasing force thereof acts on the cable guide 49 via the movable members 62A and 62B. When the steering resistance force acting on the cable guide 49 is removed, the guide cable 49 is thus restored to its neutral position, and the switching lever 51 is thus returned to the neutral position.

Figure 8:
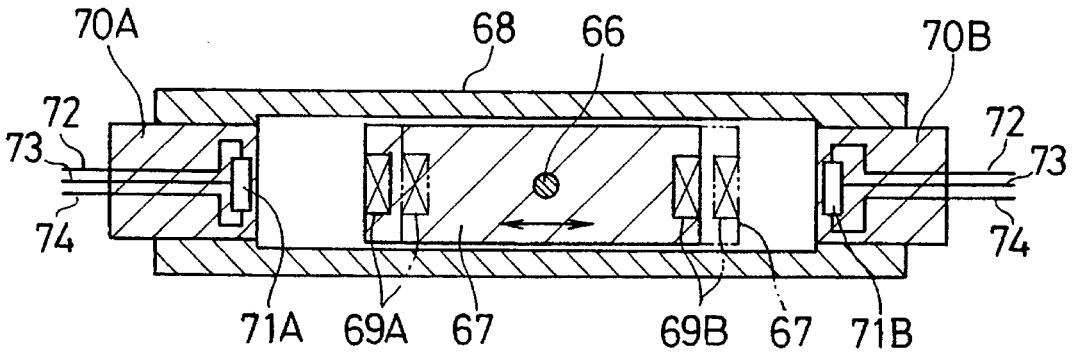
FIG. 8 is a sectional view taken along line VIII—VIII in FIG. 1.

As shown in FIGS. 1, 3 and 8, a magnet holder 67 is coupled via coupling pin 66 to the cable guide 49. The magnet holder 67 is slidable through a sensor housing 68, and it has magnets 69A and 69B provided at its opposite ends. With the sliding of the cable guide 49, the magnet holder 67 is thus caused to slide through the sensor housing 68 in the same direction and to the same extent as the cable guide 49.

The sensor housing 68 is provided with sensor holders 70A and 70B at the opposite ends of the magnet holder 67 in the sliding direction thereof. Hole ICs 71A and 71B are provided as magnetoelectric conversion sensors on the respective sensor holders 70A and 70B. The hole ICs 71A and 71B each have three terminals, i.e., a power supply terminal 72, an output signal terminal 73 and a grounding terminal 74, and they convert change in magnetic flux density to change in output voltage.

Figure 9:
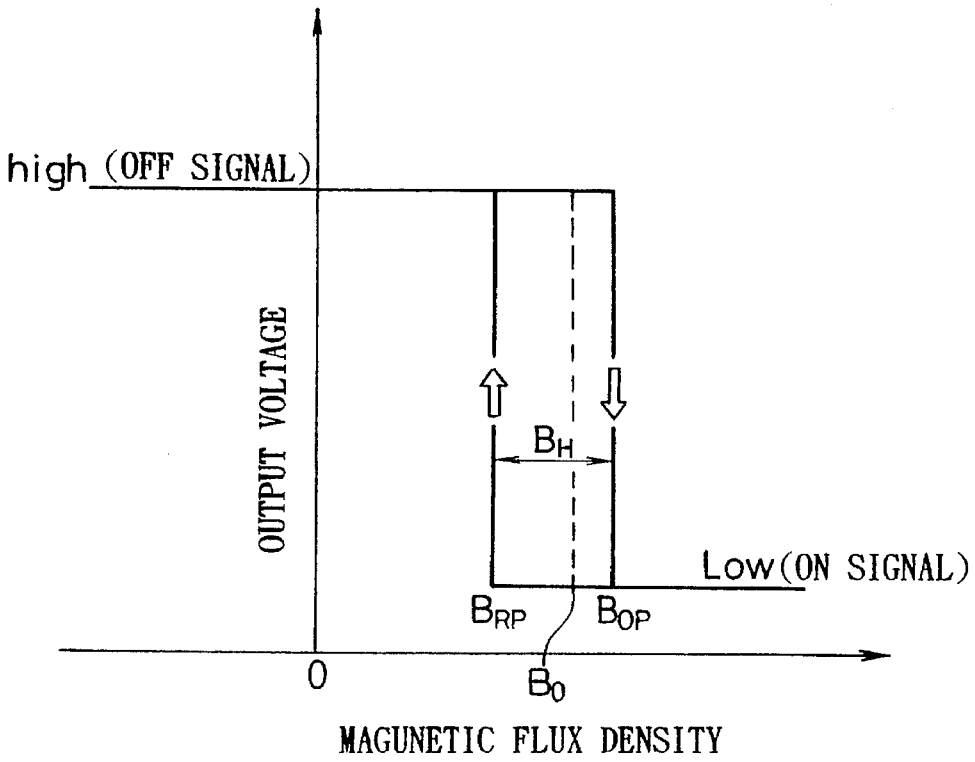
FIG. 9 is a graph showing a magnetoelectric conversion characteristic of the magnetoelectric conversion sensor (or hole IC) shown in FIGS. 1, 3 and 8.

When the cable guide 49 pushes the switching lever 51 and is displaced to an extent sufficient to operate the first or second switching poppet valve 27 or 28 via the switching lever 51 so that the magnetic flux density from the magnets 69A and 69B exceeds an operation magnetic flux density BOP as shown in FIG. 9, the hole ICs 71A and 71B provide a "low" output voltage, i.e., an "on" signal. When the cable guide 49 is not displaced to an extent sufficient to operate the first or second switching poppet valve 27 or 28 so that the magnetic flux density from the magnets 69A and 69B is lower than a restoration magnetic flux density $B_{RP}$, the hole ICs 71A and 71B provide a "high" output voltage, i.e., an "off" signal. According to the "on" or "off" signal from the hole ICs 71A and 71B, a motor 75 (FIG. 2) is started or stopped to start or stop the operating fluid supply pump 40.

The width $B_H$ of the hysteresis region of the magnetoelectric conversion characteristic of the hole ICs 71A and 71B is about 15 Gauss. In this embodiment, the displacement of the cable guide 49 is small so that the change in the magnetic flux density from the magnets 69A and 69B as received by the hole ICs 71A and 71B does not exceed the hysteresis width $B_H$. That is, when the cable guide 49 is at its neutral position, at which neither the first or the second switching poppet valve 27 or 28 is operated, the magnetic flux density received by the hole IC 71A or 71B is, for instance, shown at $B_0$ within the hysteresis width $B_H$.

Figure 10A:
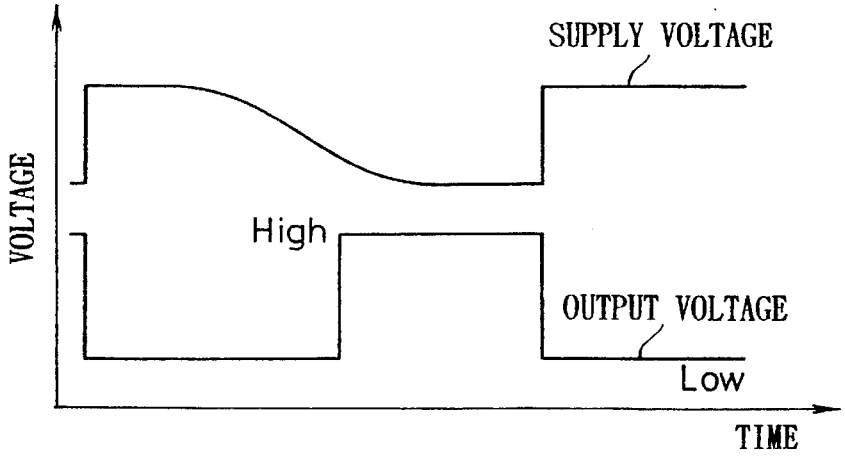
FIG. 10A is a graph showing, for the magnetoelectric conversion characteristic shown in FIG. 9, an output voltage with respect to a supply voltage while the magnetic flux density is in a hysteresis region when the supply voltage is reduced fast.
Figure 10B:
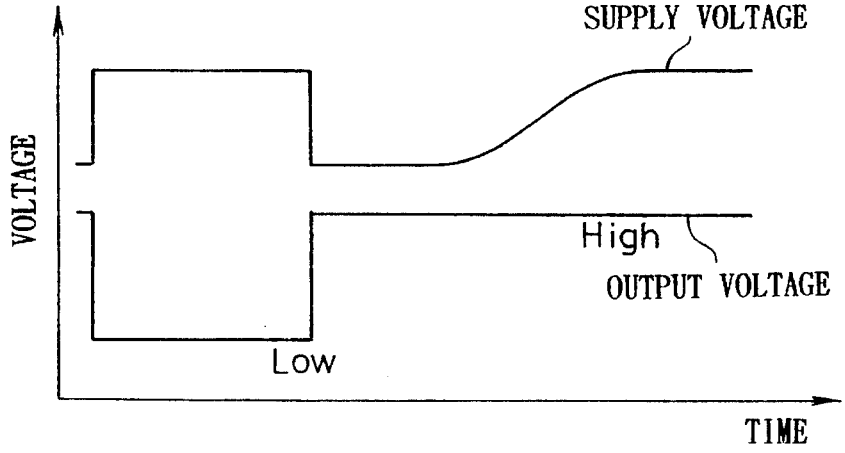
FIG. 10B is a graph showing, for the magnetoelectric conversion characteristic shown in FIG. 9, an output voltage with respect to a supply voltage while the magnetic flux density is in a hysteresis region when the supply voltage is reduced gradually.

In the meantime, when power from the power supply terminal 72 is cut off suddenly or gradually and then supplied again suddenly as shown in FIG. 10A while the magnetic flux density is between the operating magnetic flux density $B_{OP}$ and restoration magnetic flux density $B_{RP}$, the hole ICs 71A and 71B provide the "low" output voltage, i.e., the "on" signal from the output signal terminal 73 due to their circuit characteristics. However, when power from the power supply terminal 72 is cut off and then supplied gradually as shown in FIG. 10B with the magnetic flux density in the range noted above, the hole ICs 71A and 71B provide the "high" output voltage, i.e., the "off" signal from the output signal terminal 73 due to their circuit characteristics.

Figure 6:
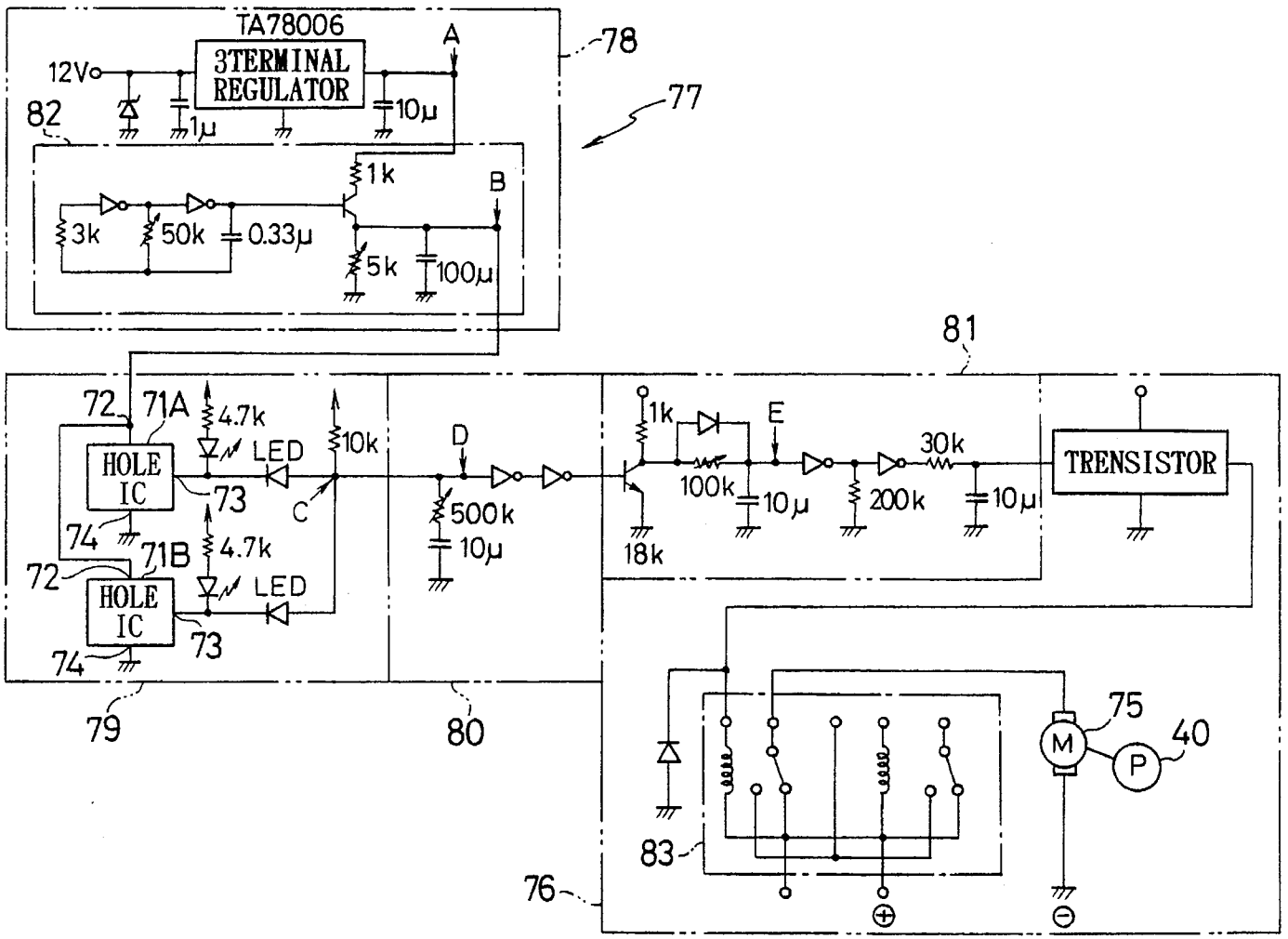
FIG. 6 is an electric circuit diagram showing a controller for a magnetoelectric conversion sensor (i.e., a hole IC) shown in FIG. 1.

From the considerations of the small changes in the magnetic flux density received by the hole ICs 71A and 71B and also of the characteristics of the hole ICs 71A and 71B, a hole IC control circuit 77 as shown in FIG. 6 is used, which is connected to a motor drive 76 for driving an electric motor 75. In the hole IC control circuit 77, the power source supplied to the power supply terminal 72 of each of the hole ICs 71A and 71B is oscillated, thereby reducing the hysteresis width $B_H$ of the hole ICs 71A and 71B and permitting detection of slight displacement of the magnet holder 67, i.e., the cable guide 49.

The hole IC control circuit 77 includes a power supply section 78 for supplying power to the power supply terminal 72 of each of the hole ICs 71A and 71B, a sensor section 79 having the hole ICs 71A and 71B, an "on" signal processor 80 connected to the sensor section 79, and an off-delay circuit 81 connected to the "on" signal processor 80 and also to the motor drive 76.

Figure 7A:
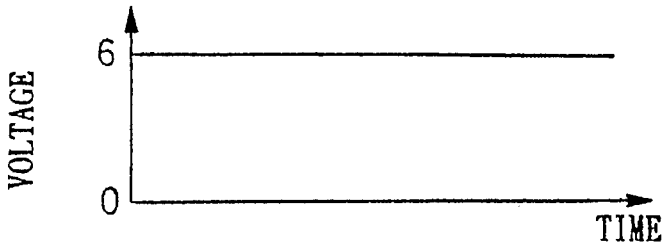
FIGS. 7A, 7B, 7C, 7D, 7E and 7F are graphs showing the voltage or signal at various points in the electric circuit shown in FIG. 6.
Figure 7B:
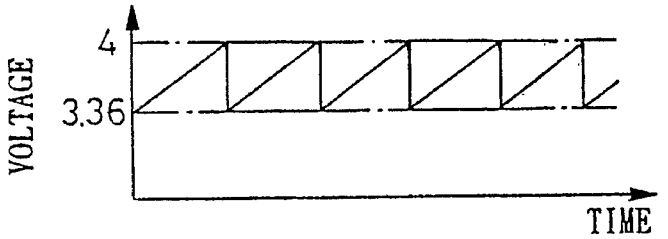
Figure 7C:
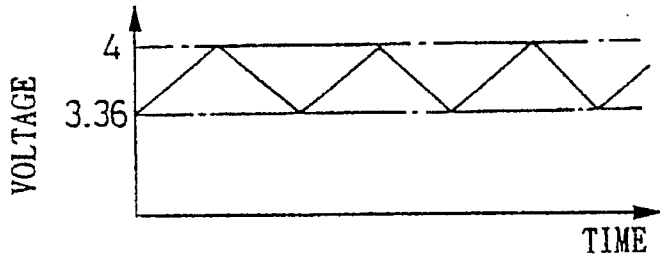

The power supply section 78 has an oscillator 82. The oscillator 82 converts a constant supply voltage at point A in the circuit, as shown in FIG. 7A, into a sawtooth oscillation wave as shown in FIG. 7B or a triangular oscillation wave as shown in FIG. 7C. Such oscillation wave is at point B in the oscillator 82. Thus, the supply voltage is changed periodically in a predetermined range of about 3.36 to 4 V, and the voltage is increased gradually in each cycle.

With the oscillator 82 having such an oscillation waveform as discussed above impressed on the power supply terminal of each of the hole ICs 71A and 71B, when the magnetic flux density acting on the hole ICs 71A and 71B is reduced from the operating magnetic flux density $B_{OP}$ to a level in the range between the operating magnetic flux density $B_{OP}$ and restoration magnetic flux density $B_{RP}$ (i.e., the range corresponding to the hysteresis width $B_H$), for instance the level $B_0$ in FIG. 9, the hole ICs 71A and 71B provide the "high" output voltage, i.e., the "off" signal. In this way, the hysteresis width $B_H$ of the hole ICs 71A and 71B is reduced, and the hole ICs 71A and 71B detect slight displacement of the magnet holder 67, i.e., the cable guide 49 and thus detect that the cable guide 49, i.e., the switching lever 51, is at the neutral position.

Figure 7D:
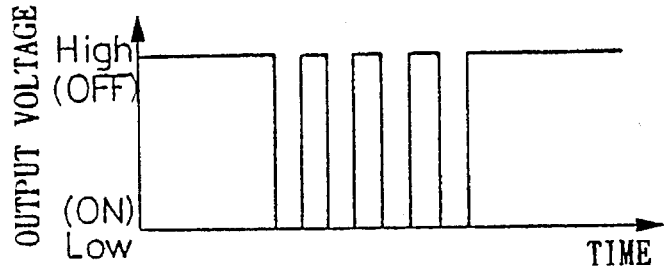
Figure 7E:
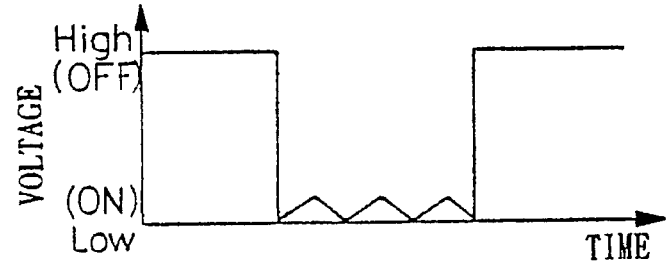

With the above supply power oscillation, the cable guide 49 is displaced to an extent sufficient to cause the switching lever 51 to operate the first or second switching poppet valve 27 or 28, and when the magnetic flux density received by the hole IC 71A or 71B exceeds the operating magnetic flux density $B_{OP}$, the hole IC 71A or 71B provides the "on" signal. This "on" on signal assumes the "on" and "off" states repeatedly in accordance with the above supply power oscillation, as shown in FIG. 7D. The waveform in FIG. 7D appears at point C in FIG. 6. The "on" signal processing section 50 processes the "on " signal becoming on and "off" repeatedly as noted above to an "on" signal having a substantially fixed value as shown in FIG. 7E and further inverts the "on" and "off" values. Its output is supplied through the off-delay circuit 51 to the motor drive 76. The waveform in FIG. 7E is of a signal at point D in FIG. 6.

The motor drive 76 starts the electric motor 75 in response to the reception of the "on" signal noted above and stops the motor 75 in response to the reception of the "off" signal. In this way, it starts and stops the operating fluid supply pump 40. Thus, when no operating force is applied to the steering wheel 43, causing no displacement of the cable guide 49 and holding the switching lever 51 at the neutral position to hold both the first and second switching poppet valves 27 and 28 inoperative, the hole ICs 71A and 71B provide the "off" signal, and the operating fluid supply pump 40 is stopped. Likewise, the operating fluid supply pump 40 is stopped with the cable guide 49 returned to the neutral position by the neutral position restoration unit 59 so that the first and second switching poppet valves 27 and 28 are inoperative. When an operating force is applied to the steering wheel 43 to cause displacement of the cable guide 49 so as to cause the switching lever 51 to operate either one of the first and second switching poppet valves 27 and 28, the hole IC 71A or 71B provides the "on" signal. The operating fluid supply pump 40 is thus started simultaneously with the operation of the first or second switching poppet valve 27 or 28. Designated at 83 in FIG. 6 is a relay circuit which directly starts and stops the motor 75 in response to "on" and "off" signed from the off-delay circuit 81 through a transistor respectively.

Figure 7F:
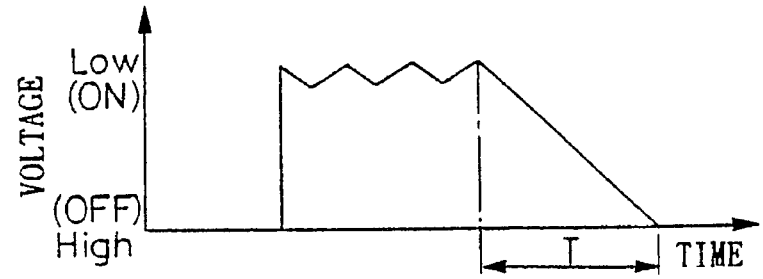

Since the operation unit 48 includes the neutral position restoration unit 59 as shown in FIG. 1, by slowly turning the steering wheel 43, the cable guide 49 is caused to repeat an operation of moving slightly, then returning to the neutral position, then moving slightly again, then returning to the neutral position again, and so forth. As a result, the operating fluid supply pump 40 is repeatedly started and stopped, so that the steering piston-and-cylinder assembly 13 may fail to generate the assist force. Accordingly, the signal from the "on" signal processing section 80 is supplied to the "off"-delay section 81, in which a delay time is set for the change of the "on" signal to the "off" signal as shown in FIG. 7F, thus delaying the "off" signal to delay the stop of the operating fluid supply pump 40. Thus, even by operating the steering wheel 43 slowly, the operating fluid supply pump 40 is started continuously to generate the steering assist force continuously. In this way, generation of a sense of abnormality of the steering wheel 43 is precluded.

The operation will now be described.

When the steering wheel 43 shown in FIG. 1 is turned neither to the left nor to the right, the cable guide 49 is not displaced via the operating cable 46. Thus, the magnet holder 67 is not displaced. The hole ICs 71A and 71B thus provide the "off" signal, and the operating fluid supply pump 40 is stationary. At this time, the switching lever 51 is at the neutral position, and the first and second switching poppet valves 27 and 28 are inoperative. Thus, the oil hydraulic pressures in the left and right chambers 25A and 25B in the steering piston-and-cylinder assembly 13 are in equilibrium. Consequently, the piston rod 22 of the steering piston-and-cylinder assembly 13 is not moved, and no assist force from the steering piston-and-cylinder assembly 13 is applied to the steering arm 18.

When the steering wheel 43 shown in FIG. 1 is turned to the left, the inner cable 46A of the operating cable 46 is moved in the direction of arrow α. Also, the outer cable 46B is moved in the direction of arrow β by the steering resistance force, and the cable guide 49 is also moved in the direction of arrow β. With the movement of the cable guide 49 the switching lever 51 is rotated in the direction of arrow O in FIG. 2 to operate the second switching poppet valve 28 so as to communicate the ports 30 and 39 of the second switching poppet valve 28 with each other. As a result, the operating fluid from the operating fluid supply pump 40 is led through the ports 30 and 31 of the first switching poppet valve 27 to the right chamber 25B of the steering piston-and-cylinder assembly 13. On the other hand, the operating fluid in the left chamber 25A is led through the ports 30 and 39 of the second switching poppet valve 28 to the drain tank 42. Thus, the piston 21 and piston rod 22 of the steering piston-and-cylinder assembly 13 are moved (i.e., accommodated) in the direction of arrow M, and a left steering assist force is applied to the steering arm 18.

When the steering wheel 43 shown in FIG. 1 is turned to the right, the cable guide 49 is displaced in the direction opposite to the above β direction. The hole IC 71A thus outputs the "on" signal to start the operating fluid supply pump 40, while at the same time causing the switching lever 51 to be rotated in the P direction in FIG. 2 to operate the first switching popper valve 27. As a result, the operating fluid from the operating fluid supply pump 40 is led through the ports 30 and 39 of the first switching poppet valve 27 to the left chamber 25A of the steering piston-and-cylinder assembly 13, and the operating fluid in the right chamber 25B is led through the ports 31 and 39 of the first switching poppet valve 27 to the left chamber 25A of the steering piston-and-cylinder assembly 13. Thus, the piston 21 and piston rod 22 of the steering piston-and-cylinder assembly 13 are moved (i.e., advanced) in the direction of arrow N. A right steering assist force is thus applied to the steering arm 18.

In the above embodiment, in which the switching section of the operating fluid switching unit 19 comprises the first and second switching poppet valves 27 and 28, compared to the case of the switching section constituted by the spool valve, the leak of operating fluid can be drastically reduced between the port 30 or 31 and the port 39 in the first or second switching poppet valve 27 or 28. Thus, when an external force is applied to the propelling unit 12 during the steering, the piston 21 and piston rod 22 of the steering piston-and-cylinder assembly 13 are not operated, and the propelling unit 12 does not react under the influence of the external force. It is thus possible to ensure the stability of steering.

Further, when voltage supplied to the hole ICs 71A and 71B as the magnetoelectric conversion sensors is once cut off and then gradually increased while the magnetic flux density is in a range between the operating magnetic flux density $B_{OP}$ and restoration magnetic flux density $B_{RP}$, the hole ICs 71A and 71B provide the "high" output voltage, i.e., the "off" signal due to their circuit characteristics. By applying a voltage, which is varied cyclically in a predetermined range and is gradually increased in each cycle, to the hole ICs 71A and 71B, the hole ICs 71A and 71B provide the "off" signal while the magnetic flux density is between the operating magnetic flux density $B_{OP}$ and restoration magnetic flux density $B_{RP}$. It is thus possible to reduce the hysteresis width $B_H$ of the output characteristic of the electric signal (i.e., "on" and "off" signals) with respect to the magnetic flux density. Thus, it is possible to detect a slight change in the magnetic flux density to detect a slight displacement of the cable guide 49 so as to start or stop the operating fluid supply pump 40.

Further, since the operating fluid path 29 is provided with the check valve 41 between the port 30 of the first switching poppet valve 27 and the operating fluid supply pump 40, when an external force is applied to the piston rod 22 of the steering piston-and-cylinder assembly 13 via the propelling unit 12 in the neutral state with the operating fluid supply pump 40 stopped and without any assist force provided from the steering piston-and-cylinder assembly 13, it is possible with the state of closure of the valve section 34 of the first switching poppet valve 27 and the valve seat 37 and also with the check valve 41 to block the flow of operating fluid from the left and right chambers 25A and 25B of the steering piston-and-cylinder assembly 13. It is thus possible to hold the propelling unit 12 stationary in the neutral state irrespective of application of an external force to the propelling unit 12.

Now a second embodiment of the invention will be described with reference to FIGS. 11 and 12. In the second embodiment, parts like those in the preceding first embodiment are designated by like reference numerals and symbols, and they are not described any further.

Figure 11:
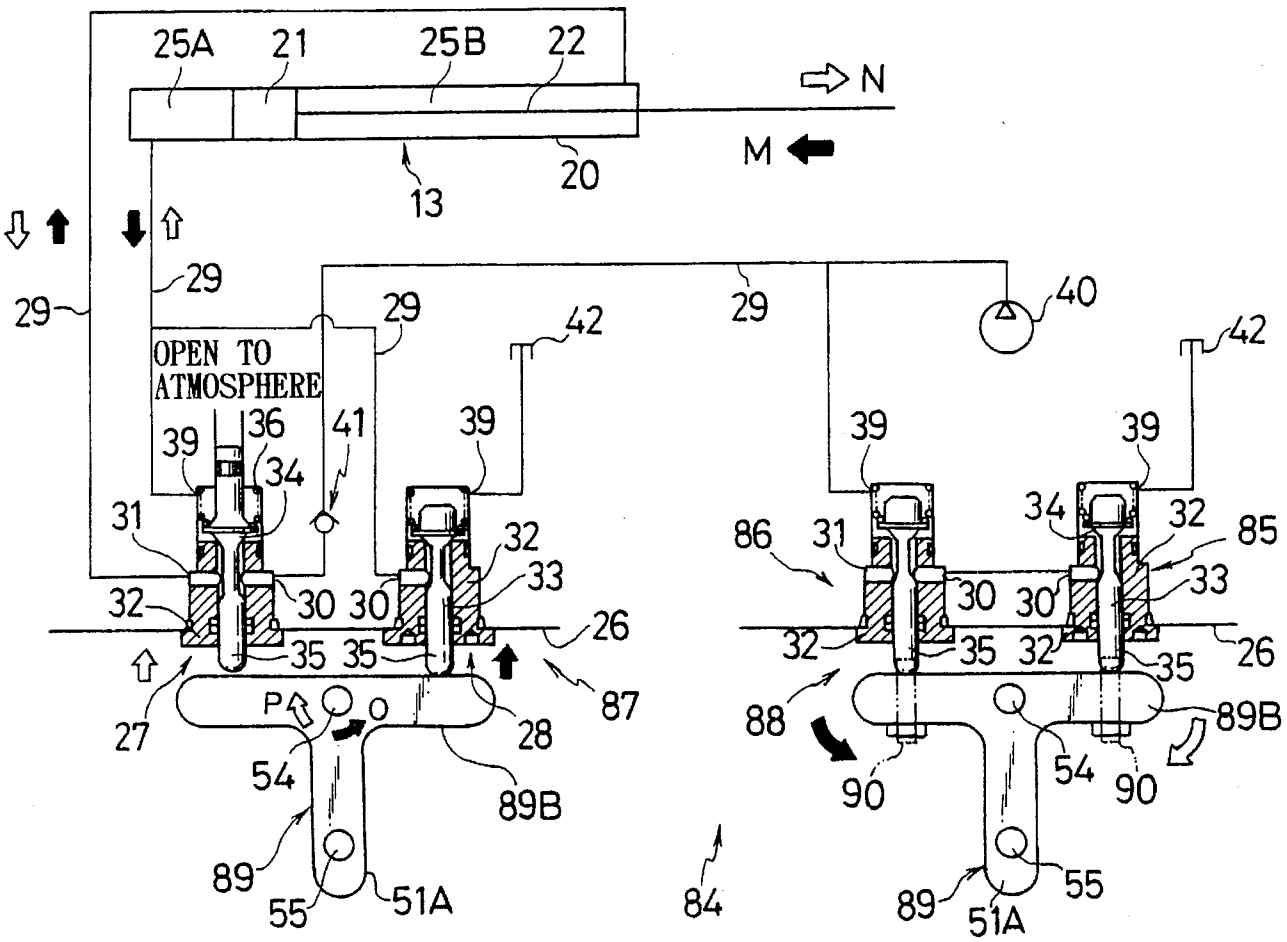
FIG. 11 is an oil hydraulic circuit diagram showing a second embodiment of the steering system for a boat propelling apparatus according to the invention.

As shown in FIG. 11, the second embodiment of the invention comprises an operating fluid switching unit 84, which includes a pair of, i.e., a third and a fourth, switching poppet valves 85 and 86 in addition to the first and second switching poppet valves 27 and 28. The first and second switching poppet valves 27 and 28 constitute a switching section 87 for switching the flow of operating fluid directed from the operating fluid supply pump 40 to the steering piston-and-cylinder assembly 13 and the flow of operating fluid directed from the steering piston-and-cylinder assembly 13 to the drain tank 42. The third and fourth switching poppet valves 85 and 86, on the other hand, constitute a drain control section 88 to control the flow of operating fluid directed from the operating fluid supply pump 40 to the drain tank 42.

Figure 12A:
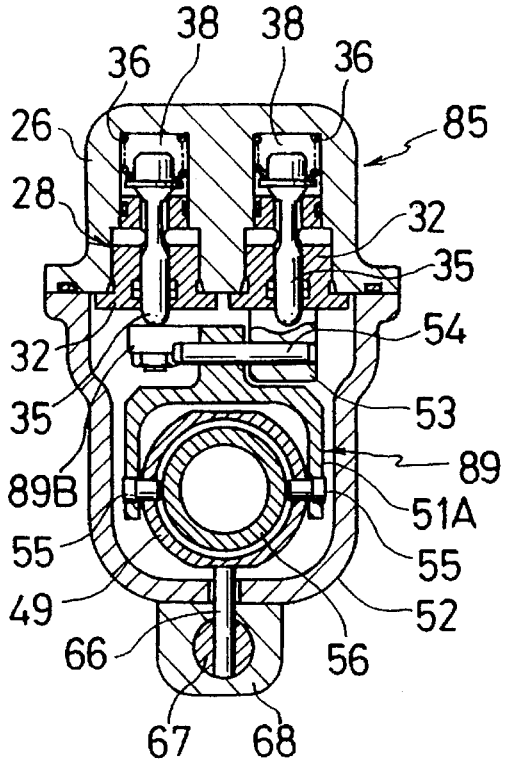
FIG. 12A is a sectional view similar to FIG. 3 but showing the second embodiment shown in FIG. 11.
Figure 12B:
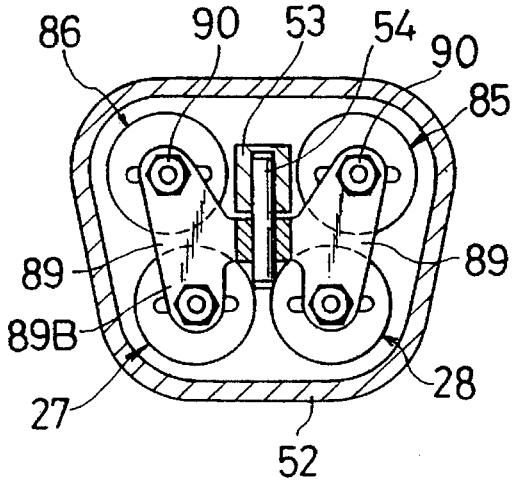
FIG. 12B is a sectional view similar to FIG. 4 but showing the second embodiment.

The third switching poppet valve 85 has the same structure as the second switching poppet valve 28, and the fourth switching poppet valve 86 has the same structure as the first switching poppet valve 27. The third switching poppet valve 85, as shown in FIG. 12B, is provided on the same side as the second switching poppet valve 28 with respect to the support pin 54. The fourth switching poppet valve 86 is provided on the same side as the first switching poppet valve 27 with respect to the support pin The switching lever 89 as shown in FIG. 12A, has an upper portion 89B, which, as shown in FIG. 12B, extends in four directions to a piston above the lower end of the poppets 35 of the first to fourth switching poppet valves 27, 28, 85 and 86. Adjustment screws 90 are each screwed in each of end portions of the upper portion 89B that extend to the third and fourth switching poppet valves and 86. The end of the adjustment screws 90 are pushing the poppet 35 of the third and fourth switching poppet valves 85 and 86 at all times. Thus, in the third and fourth switching poppet valves 85 and 86, the valve section 34 is normally spaced apart from the valve seat 37. In this state, the ports 30 and 31 of the fourth switching poppet valve 86 are in communication with the port 39 thereof, while the ports 30 and 39 of the third switching poppet valve 85 are in communication with each other. In other words, the third and fourth switching poppet valves 85 and 86 are normally open valves.

When the switching lever 89 is rotated about the support pin 54 in the direction of arrow O, the second switching poppet valve 28 and the third switching poppet valve 85 are operated. When the switching lever 89 is rotated about the support pin 54 in the direction of arrow P, on the other hand, the first switching poppet valve 27 and the fourth switching poppet valve 86 are operated. The third and fourth switching poppet valves 85 and 86 are adjusted by the adjustment screws 90 such that they are operated by a predetermined delay time with respect to the operation of the first and second switching poppet valves 27 and 28. The predetermined delay time noted above is increased by increasing the extent of projection of the adjustment screws 90.

Thus, when no operating force is applied to the steering wheel shown in FIG. 1, the switching lever 89 is at its neutral position. The first to fourth switching poppet valves 27, 28, 85 and 86 are thus in the inoperative state. In this state, the hole ICs 71A and 71B are providing the "off" signal, and the operating fluid supply pump 40 is stopped.

When an operating force is applied to the steering wheel 43, the cable guide 49 is displaced via the operating cable 46. Thus, the hole ICs 71A and 71B provide the "on" signal to start the operating fluid supply pump 40. At the same time, with the displacement of the cable guide 49 the switching lever 89 is rotated in the direction of arrow O or P to operate the first or second switching poppet valve 27 or 28. After the lapse of a predetermined period of time from this instant of operation, the third or fourth switching popper valve 85 or 86 is operated.

In an initial stage after the start of the operating fluid supply pump 40, the operating fluid therefrom partly flows to the third and fourth switching poppet valves 85 and 86, while the remainder of the operating fluid flows to the first or second switching poppet valve 27 or 28. When the third or fourth switching poppet valve 85 or 86 is closed after the lapse of the predetermined time, the operating fluid from the operating fluid supply pump 40 all flows to the first or second switching poppet valve 27 or 28. Thus, at the time of the start of the operating fluid supply pump 40 the operating fluid will not suddenly flow through the first or second switching poppet valve 27 or 28 in the switching section 87 into the steering piston-and-cylinder assembly 13. Thus, at the time of the start of the operating fluid supply pump 40 the assist force generated by the steering piston-and-cylinder assembly 13 can be smoothly increased, thus ensuring a smooth steering characteristic.

A third embodiment of the steering system for a boat propelling apparatus according to the invention will now be described. In this instance, the operating fluid switching unit has the same structure as the operating fluid switching unit 84 in the second embodiment shown in FIG. 11, and the operating fluid supply pump 40 is operative at all times. In this case, when the hole IC 71A or 71B provides the "off" signal, the motor drive 76 shown in FIG. 6 causes low speed rotation of the operating fluid supply pump 40. When the hole IC 71A or 71B provides the "on" signal, the motor drive 76 causes normal high speed rotation of the operating fluid supply pump 40.

When there is no operating force acting on the steering wheel 43 so that the cable guide 49 and the switching lever 98 are held in their neutral positions, the operating fluid supply pump 40 is rotating at low speed, and none of the first to fourth switching poppet valves 27, 28, 85 and 86 is operative. In this state, the operating fluid from the operating fluid supply pump 40 is forced, as shown in FIG. 11, from the port 39 of the fourth switching poppet valve 86 through the port 30 thereof and the ports 30 and 39 of the third switching poppet valve 85 to the drain tank 42.

When an operating force is acted on the steering wheel 43, the cable guide 49 is displaced, causing the hole IC 71A or 71B to provide the "on" signal to cause high speed rotation of the operating fluid supply pump 40 while also operating the switching lever 89 to close the third or fourth switching poppet valve 85 or 86 and operate the first or second switching poppet valve 27 or 28. Thus, the operating fluid from the operating fluid supply pump 40 flows through the first or second switching poppet valve 27 or 28 to the left or right chamber 25A or 25B of the steering piston-and-cylinder assembly 13, thus causing an assist force to be applied to the steering arm 18.

In the above third embodiment, since the operating fluid supply pump 40 is operative at all times, there is no delay in starting of the operating fluid supply pump 40 with respect to the operation of the cable guide 49 in the operation unit 84. It is thus possible to lead operating fluid smoothly through the first or second switching poppet valve 27 or 28 to the steering piston-and-cylinder assembly 13. It is thus possible to generate the steering assist force from the steering piston-and-cylinder assembly 13 quickly and smoothly in response to operation of steering wheel 43.

In connection with the above-described first to third embodiments, it is possible to provide adjustment screws 90 on end portions of the switching lever 51 or 89 corresponding to the first and second switching poppet valves 27 and 28. Also, as a modification of the third embodiment, the switching lever 89 of the operating fluid switching unit 84 is not provided with any adjustment screw 90 so as to directly push the poppets 35 of the third and fourth switching poppet valves 85 and 86.

While the preferred embodiments of the invention have been described with reference to the drawings, they are by no means limitative, and various changes and modifications are possible without departing from the scope and spirit of the invention.

What is claimed is:

1. A steering system for a boat propelling apparatus comprising:

a propelling unit mounted on a boat via a bracket and having a steering arm;

an operation unit operable by operating a steering wheel installed in the boat, said operating unit being coupled to the steering arm;

a steering piston-and-cylinder assembly mounted on the bracket and having a piston rod connected to the steering arm, said steering piston-and-cylinder assembly being connected to and capable of being supplied with operating fluid from an operating fluid supply pump and a drain tank; and an operating fluid switching unit disposed between said steering piston-and-cylinder assembly on one hand and the operating fluid supply pump and the drain tank on the other hand and coupled to said operation unit, for switching the flow of operating fluid with the operation of said operation unit;

said operating fluid switching unit including a switching section coupled to said operation unit, the switching section including a poppet valve.

2. The steering system for a boat propelling apparatus according to claim 1, wherein as the poppet valve two poppet valves are provided, one of the two poppet valves, serving to switch the flow of operating fluid directed from the operating fluid supply pump to the steering piston-and-cylinder assembly, the other poppet valve serving to control the flow of operating fluid directed from the steering piston-and-cylinder assembly to the drain tank, the two poppet valves being operated selectively.

3. A steering system for a boat propelling apparatus comprising:

a propelling unit mounted on a boat via a bracket having a steering arm;

an operating unit operable by operating a steering wheel installed in the boat, said operating unit being coupled to the steering arm;

a steering piston-and-cylinder assembly mounted on the bracket and having a piston rod connected to the steering arm, said steering piston-and-cylinder assembly being connected to and capable of being supplied with operating fluid from an operating fluid supply pump and a drain tank; and an operating fluid switching unit disposed between said steering piston-and-cylinder assembly on one hand and the operating fluid supply pump and the drain tank on the other hand and coupled to said operation unit, for switching the flow of operating fluid with the operation of said operation unit;

the operating fluid switching unit including a switching section comprising a poppet valve for switching the flow of the operating fluid directed from the operating fluid supply pump to the steering piston-and-cylinder assembly and a normally open drain control section comprising a poppet valve for controlling the flow of the operating fluid directed from the operating fluid supply pump to the drain tank;

the drain control section being closed after the lapse of a predetermined period of time from the instant of start of the operating fluid supply pump, whereby the operating fluid is led to the switching section only.

4. A steering system for a boat propelling apparatus comprising:

a propelling unit mounted on a boat via a bracket and having a steering arm;

an operation unit operable by operating a steering wheel installed in the boat, said operating unit being coupled to the steering arm;

a steering piston-and-cylinder assembly mounted on the bracket and having a piston rod connected to the steering arm, said steering piston-and-cylinder assembly being connected to and capable of being supplied with operating fluid from an operating fluid supply pump and a drain tank; and an operating fluid switching unit disposed between said steering piston-and-cylinder assembly on one hand and the operating fluid supply pump and the drain tank on the other hand and coupled to said operation unit, for switching the flow of operating fluid with the operation of said operation unit;

the operating fluid switching unit including a switching section comprising a poppet valve for switching the flow of the operating fluid directed from the operating fluid supply pump to the steering piston-and-cylinder assembly and a normally open drain control section comprising a poppet valve for controlling the flow of the operating fluid directed from the operating fluid supply pump to the drain tank;

the operating fluid supply pump being operative at all times to lead operating fluid through the drain control section to the drain tank in the inoperative state of said operation unit while leading operating fluid through the switching section to the steering piston-and-cylinder assembly in the operative state of said operation unit.

* * * * *